US005098772A

United States Patent [19]

af Strom

[11] Patent Number: 5,098,772

[45] Date of Patent: Mar. 24, 1992

[54] COMPOSITE SHEET FOR TRANSFER OF AN IMAGE FROM SAME TO A SUBSTRATE

[76] Inventor: Oscar B. F. af Strom, Ave. Residencial Chiluca 207, Club Campestre Chiluca, Atizapan

[21] Appl. No.: 651,113

[22] Filed: Feb. 5, 1991

Related U.S. Application Data

[63] Continuation of Ser. No. 504,082, Apr. 2, 1990, abandoned, which is a continuation of Ser. No. 408,410, Sep. 14, 1989, abandoned, which is a continuation of Ser. No. 302,057, Jan. 25, 1989, abandoned, which is a continuation of Ser. No. 61,199, Jun. 10, 1987, abandoned.

[30] Foreign Application Priority Data

Jun. 13, 1986 [MX] Mexico ..... 2797/61228

[51] Int. Cl.[5] ..... B41M 3/12

[52] U.S. Cl. ..... 428/211; 427/149; 428/537.5; 428/914

[58] Field of Search ..... 428/211, 537.5, 914; 427/149

[56] References Cited

U.S. PATENT DOCUMENTS

| | | | |
|---|---|---|---|
| 470,899 | 3/1892 | Robinson | 156/234 |
| 555,927 | 4/1858 | Asnes | 427/149 |
| 1,851,369 | 3/1932 | Mullan | 428/195 |
| 2,183,315 | 12/1939 | Humphner | 41/33 |
| 2,409,564 | 10/1946 | Heinecke et al. | 95/8 |
| 2,496,325 | 2/1950 | Wittgren | 154/46.8 |
| 2,607,526 | 9/1951 | Biegen | 156/235 |
| 2,641,562 | 6/1953 | Chartrand et al. | 154/46.8 |
| 2,758,035 | 8/1956 | Matthes | 117/8.6 |
| 2,970,076 | 1/1961 | Porth | 154/99 |
| 3,055,787 | 9/1962 | Mackenzie | 156/235 |
| 3,344,012 | 9/1967 | af Strom | 428/202 |
| 3,350,254 | 10/1967 | Morgan et al. | 156/235 |
| 3,607,525 | 9/1971 | Strom | 161/99 |
| 3,985,602 | 10/1976 | Stuart | 428/195 |
| 4,089,722 | 5/1978 | Holoubek | 156/235 |
| 4,392,905 | 7/1983 | Boyd et al. | 156/235 |
| 4,544,430 | 10/1985 | Shepherd | 156/235 |
| 4,610,744 | 9/1986 | Smith et al. | 156/235 |

FOREIGN PATENT DOCUMENTS

| | | | |
|---|---|---|---|
| 555927 | 4/1958 | Canada | 428/195 |
| 000168 | 3/1979 | European Pat. Off. | 428/195 |
| 3223569 | 12/1983 | Fed. Rep. of Germany | 428/195 |
| 59-127791 | 7/1984 | Japan | 428/211 |
| 29026 | of 1914 | United Kingdom | 428/195 |

*Primary Examiner*—Pamela R. Schwartz
*Attorney, Agent, or Firm*—John D. Upham

[57] ABSTRACT

Decal support sheets, decals, and process for transfer of an image to a substrate. No release layer is interposed between the paper sheet base and the plastic film of the support sheet. The plastic film is applied to the paper base so that it adheres well to the porous surface of the paper and adopts its texture but does not penetrate it. When the decal is soaked in water the adhesion between paper base and plastic film is substantially released but they can withstand substantial horizontal forces without separating.

14 Claims, 7 Drawing Sheets

COMPOSITE SHEET FOR TRANSFER OF AN IMAGE FROM SAME TO A SUBSTRATE

This is a continuation of application Ser. No. 07/504,082, filed Apr. 2, 1990, which in turn is a continuation of application Ser. No. 07/408,410 filed Sept. 14, 1989, which in turn is a continuation of application Ser. No. 07/302,057 filed Jan. 25, 1989, which in turn is a continuation of application Ser. No. 07/061,199 filed June 10, 1987, each entitled COMPOSITE SHEET AND PROCESS FOR TRANSFER OF AN IMAGE FROM SAME TO A SUBSTRATE, and each now abandoned.

SUMMARY OF THE INVENTION

This invention refers to decals and their use, i.e., a composite support sheet, and processes for the transfer of an image to a substrate from a support sheet on which said image has been directly applied, or to which it has been transferred from another sheet of paper. Traditionally, support sheets which are used for transfers have a release layer, of silicone for dry release, or of a water soluble material for wet release. The support sheet in accordance with this invention provides mainly for wet release, but without any special layer in order to obtain this effect. Instead of the usual wet release layer, the support sheet in accordance with this invention utilizes a principle which was discovered during experiments: that a plastic, i.e. polymer, film which has been laminated or applied to a paper surface, without penetration, will release if the bond is made wet, notwithstanding the fact that previously it was adhering forcefully. Accordingly, a support sheet in accordance with this invention, consists of a base of paper having a porous surface; on one side of said paper the plastic film is applied in such a manner that the plastic film adopts the texture of the porous paper surface, but does not penetrate. The other side of the paper base may be covered with a layer which adheres forcefully to the paper surface and makes it more waterproof, such as a printing ink or paint layer, or a sheet of paper or plastic laminated to said surface. When the transfer is to be applied, the printing ink or paint layer is erased, or the laminated sheet peeled off. As a result, the pores of the back of the support sheet, which previously only would absorb little water, if submerged in water, open up. For this reason, water penetrates the paper well if the sandwich is submerged, until reaching the plastic film, which releases and could be lifted together with the image which has been applied on the film. Notwithstanding, the film with the image stays on the support sheet until the image has been wiped dry and given a layer of adhesive. The relatively strong horizontal forces during this step do not cause sliding of the image, which is united with the plastic film, which in turn is forcefully supported or kept in place in the horizontal plane, due to the texture of the paper base and the reversed one of the plastic film. Thereafter the sandwich is applied over the desired substrate with use of heat and/or pressure and/or adhesive. The paper base of the support sheet which is still wet during this step and for this reason serves as an elastic cushion, giving the transferred image the same texture as the substrate, is removed, leaving the image adhering to the substrate, protected by the transferred plastic film.

INTRODUCTION

This invention relates to methods for direct transfer of an image which has been printed or painted on a support sheet, or indirect transfer of images printed or painted on paper, or some other material. The field of application includes making of leaflets, indoor as well as outdoor ads, printing of fabric and transfer of reproductions as well as works of art, among other things.

ANTECEDENTS OF THE INVENTION

Traditionally, the transfers of images, or, as they are known within the industry, decals, are of two types: those which have a dry release and those which have a wet release. This invention is principally related to decals with wet release; those which are available in the market, have an image printed on a paper which has previously been covered with a layer soluble in water. When the decal is soaked with water and pressed on a surface on which the image is to appear, this layer dissolves and becomes soft, so that the paper may be removed, leaving the image on the desired surface.

The paper on which the image is printed is known as a wet release decal paper, normally made up of a paper of good quality which is coated with a water soluble emulsion, e.g. starch and gum. The paper may have been specially treated in order to neutralize contraction and expansion due to meteorological conditions. The coated paper is known as a "simplex" paper. If it is made to adhere to another paper, it becomes a stronger kind of decal paper, known as a "duplex" paper.

The image may be printed on the decal paper with known methods, such as printing, copying or drawing directly or in reverse, depending on the final surface. Normally, the printer begins by application of a coat of lacquer or varnish on the decal paper surface. Thereafter, he prints the image on the lacquer. Instead of printing directly on the decal paper, the image could also be transferred from another paper, on which it had been applied with known methods, mentioned above. Normally, the decal is applied on desired substrate with the use of an adhesive, varnish, emulsion or solution of special kind, etc. Before applying the decal, it is submerged in water for a short while, whereafter the decal is applied in its exact position and the paper is slid off. The sliding-off results from the dissolution in water of the decal's water soluble layer.

As a variation, a decal paper is also made with a lacquer or varnish coat already over the water soluble layer. On this type of decal paper it is possible to print directly on the coat of lacquer or varnish.

A transfer resulting from a decal on which the image has been applied directly on the decal paper surface is called a "direct transfer". On the other hand, if the decal has an image which has been transferred from another paper, on which it was originally applied, the transfer to the substrate is called an "indirect transfer".

Dry release decal papers, rather than coating the paper with a water soluble layer, rely on a coating of a dry release material such as silicone, polyethylene, or other material that has little affinity for the layer of lacquer on which the image is to be printed or transferred. After application of the image to the final substrate, the paper backing of the decal is stripped off with the dry release layer adhering to it.

Existing wet release decal papers work well, notwithstanding the fact that they have some disadvantages. Firstly, the water soluble layer creates difficulties in respect of storage of the decals as well as the decal paper. In addition to the expansion and retraction caused by atmospheric conditions, there is always the risk that the water soluble layer may dissolve rapidly. A small amount of water at one of the edges could cause this effect. For this reason it is necessary to give much care to the storage of the decal paper as well as the decals, in order to avoid damage caused by water or humidity. The rapid release of the water soluble layer might be an advantage from the user's point of view, if one only considers the use of a ready made decal, but could be disastrous for a user of a decal paper while he is transferring an image from another paper. The fact is that water is used for this process in order to remove the paper on which the image, which is bonded to the decal paper during this process, was originally printed.

It is difficult to control the flow of water during this step of the process, and some may spill over one of the edges and penetrate the water soluble layer, destroying the decal paper as well as the image. The same may occur if the coat of lacquer has some cuts through which water could accidentally pass. In order to avoid such mishaps, a cover of the edges and reverse side of the decal was designed by this inventor, see U.S. Pat. No. 3,344,012. Nevertheless, such cover naturally increases the cost of manufacture of a decal.

OBJECTIVES OF THE INVENTION

This invention was conceived and developed with the aim to make a decal paper, or, as it is technically known, a transfer support, below referred to as a support sheet, as well as to design a process which retains the advantages of the paper and process mentioned above, but eliminates their respective disadvantages. In particular, the objective has been to develop a support sheet which, in addition to receiving a directly applied image should be specially adequate for application of images transferred from other paper as well as for this process.

In accordance with the mentioned aim, another objective has been to design a support sheet as well as a process which make it possible to remove the paper base of a transferred image without risking that the film of the support sheet releases or becomes destroyed.

While the support sheet in accordance with the aforementioned objective must be resistant to water, another objective has been to offer rapid release with the aid of water during the last stage of the process.

Another objective has been to facilitate transfers with the image held in a very thin layer in order to obtain optimum texture of the transferred image. A related object has been to design a support sheet as well as a process which facilitates the adoption of the substrate texture by transferred images.

An additional objective has been to offer a decal which is sufficiently rigid to permit hand trimming of intricate details of the image, and which preserves its shape and form without undue effects of temperature and humidity.

A vital objective has been to offer a long shelf life of the support sheets as well as of the resultant decals.

The final, but most important objective has been to design a support sheet and a process for its use for decals and transfers which are simple and economic, making possible the transfer of an image from another sheet of paper, utilizing common paper as well as lacquers, varnishes, emulsions, adhesives and solutions for the formation of the film of the support sheet, which are readily available in the market, including those which are printed, laminated or otherwise applied over images in books, periodicals, and post cards, etc.

EXPLANATION OF THE INVENTION

In accordance with this invention, a special support sheet is prepared, which, in contrast to the existing ones, does not have a release layer, utilizing dry paper or paper board as a base. The surface of the paper must be porous with a seemingly almost infinite number of elevations and depressions, visible with the aid of a looking glass. The surface of one of the sides is covered with a film prepared by extrusion or blowing of a thermoplastic resin, or from a lacquer, varnish, emulsion in water, or solution of a plastic resin. As of today the majority of said lacquers, etc., have a base of plastic, thermoplastic or thermosetting. The resulting film will below be referred to as "the plastic film". In accordance with one example of the invention, the other side of the paper may be made resistant to water by having the surface printing or colored, or by having a sheet of paper or plastic adhering, e.g., with the aid of water-resistant adhesive. The plastic film has three objectives: Firstly, it serves as a protective film for the transferred image; secondly, it serves as a water proof layer on the side of the paper where it is located; thirdly, it serves as a tie-coat in order to adhere coatings of images transferred from other papers. The plastic film must not substantially penetrate the surface of the paper of the support sheet, but must still adhere well to said surface, and its surface of contact must obtain the same texture as that of the paper, though in reverse. No release layer is interposed between paper base and plastic film, nor is there need for any release agent to be incorporated in the paper or in the plastic film because the adherance between paper base and plastic film is released by water.

In accordance with another version of the support sheet, specifically intended for images transferred from other papers, the support sheet does not initially have any film, the same being applied at the same time and together with the image.

The decal is obtained by application of the image on the plastic film of the support sheet, in reverse for transfer to non-transparent surfaces, and right for transfer to transparent objects, utilizing known methods for the application, such as printing, copying or drawing and painting in respect of direct transfers. As regards indirect transfers, the image is transferred to the support sheet from another paper in accordance with a known process. Accordingly, the image is first coated with a film of plastic. Thereafter the paper with the image is pressed to the support sheet with the coated image against the plastic film. Heat and/or pressure is applied until a good bond is obtained. The paper base of the image is thereafter treated with water in order to make the paper soft in order that it may be removed completely, leaving the coated image to appear in reverse on the plastic film of the support sheet.

The support sheet in accordance with this invention is specially suited for this transfer process. The coating of the image is firmly sustained by the plastic film of the support sheet which, in turn, is firmly kept in position by the texture of the support sheet paper base. This grip between the paper and the plastic film is of special importance during the stage of the process during which the paper base of the image is being removed and the bond is subject to mechanical forces which principally act in the horizontal plane.

There are a number of paper qualities which function, as long as the surface is sufficiently porous. A paper with a smooth, glazed surface is not desirable. The paper must not fragmentize when submerged, but release in one piece from the plastic film. The paper to be used as base of a support sheet to which an image is to be transferred ought to have good resistance to water, as long as the surface has not been "opened".

The function of the plastic film to make the support sheet surface waterproof offers the advantage that one may remove the paper base of the image in a safe manner, even with water spilling over the edges, which would be disastrous with a conventional decal paper. In fact, a sandwich of the kind described may be submerged for several minutes without much water penetrating the paper base of the decal.

If one is going to apply the decal on an obscure, i.e. dark, surface, it will be necessary to apply a white layer over the reverse image, if the printing inks are transparent. This layer ought to be compatible with the plastic film of the support sheet, as well as with the printing inks and the desired substrate. This white layer may also serve as adhesive. On the other hand, some adhesives which are applied immediately prior to application of the decal on the substrate, are not compatible with the printing inks of the image. If this is the case, it will be necessary to first apply a tie-coat over the printing ink layer. Such tie coat may be a vinyl paste.

Said white coating of the image may be applied before or after trimming the decal to size and form desired. In a printing shop, where the image is printed on the support sheet film, this step is normally carried out in one of the printing presses. However, an image which has been obtained by transfer from another paper is normally trimmed by hand. In order to facilitate this step, the paper base of the support sheet has been selected for the purpose of providing the required rigidity.

If one wants to store ready decals, this can be done for years without changes in shape or release properties. This latter is due to the lack of a layer sensitive to humidity, as in traditional wet release decals, or a silicone layer, which could age, a comon complaint in respect of dry release decals.

When a decal is ready for application, regardless of whether it has had the image applied by direct printing, or by transfer from another paper, the reverse side will first be treated in a manner so as to erase the printed or colored layer, if any, or peel off the laminated sheet, if any, exposing the paper surface which is very porous. Thereafter, the decal is submerged in water, which easily enters the open reverse (paper) side, having as a result that the film releases from the paper. At this stage it would be possible to lift the film and the coated image united to the same, vertically, and separate it completely, if one so desires. Notwithstanding, if the film is left in its original position, it continues to be sustained firmly in the horizontal plane by the texture of the paper. This facilitates the following steps: firstly to remove the decal from the water and place it on a plane surface with the image up. The image is wiped completely dry. Thereafter, the image is given a coat with adhesive suitable to bond it to the desired substrate. These two steps cause strong horizontal forces to act on the coated image, which could move it sideways were it not firmly sustained by the texture of the paper and the film.

Thereafter the decal is placed with the coated image down in the desired position on the substrate. Heat and/or pressure is applied. The paper base of the decal which is still wet serves as an elastic cushion under pressure, which results in the image adopting the same texture as the substrate to which it has been transferred. The effect is increased further by the fact that the coating of the image and the plastic film of the support sheet can be very thin, less than one mil.

When the bond is dry, a matter of seconds when one applies heat, the decal paper base is removed, leaving the image glued to the substrate, protected by a plastic cover. This cover may consist of the plastic film of the support sheet and/or the coating originally given to the image before it was transferred to the support sheet, which if they are compatible, may integrate into one layer. But in certain circumstances, one may be able to remove the film of the support sheet, leaving the image protected by the coating only, which was originally given to it. This happens if the image has been coated with a layer which does not adhere sufficiently to the film of the support sheet.

An economic version of the support sheet in accordance with this invention, especially suited for transfer of images which have been printed on other papers, does not have any plastic film applied to the base of paper. Instead of making this application during the manufacture of the support sheet, the film will be applied by the user, at the same time and together with the image (which is being transferred on a plastic film). Accordingly the coat given to the image will be the only coating of the ready decal, which in other aspects equals the version mentioned above.

The achievement of the objectives will become clear from the detailed description in connection with the attached drawings.

DRAWINGS

FIG. 1*a* is a diagrammatic section of a support sheet according to this invention, amplified on an exaggerated scale in order to illustrate the details.

FIG. 1*b* is an amplified diagrammatic section of another version of the support sheet shown in FIG. 1*a*.

FIG. 1*c* is an amplified diagrammatic section of the lower part of another version of the support sheet shown in FIG. 1*a*.

FIG. 1 *d* is an amplified diagramatic section of a support sheet in accordance with this invention, especially useful for preparing pre-printed decals.

FIG. 2*a* is an amplified diagrammatic section of a support sheet in accordance with this invention, intended for transfers of images applied on other paper.

FIG. 2*b* is an amplified diagrammatic section of another version of the support sheet shown in FIG. 2*a*.

Figure 18A:
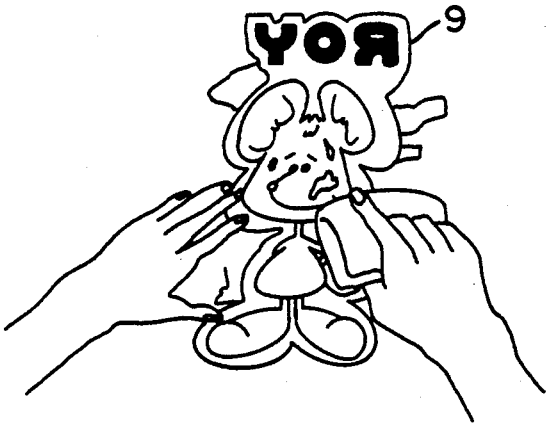

FIG. 18*a* is a perspective view, illustrating how the image is wiped dry after the decal has been submerged in water.

Figure 18B:
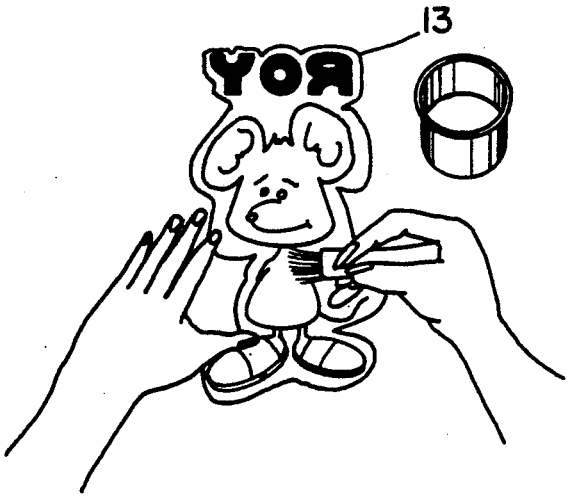

FIG. 18*b* is a perspective view, illustrating how adhesive is applied before the decal is applied on a desired substrate.

Figure 19:
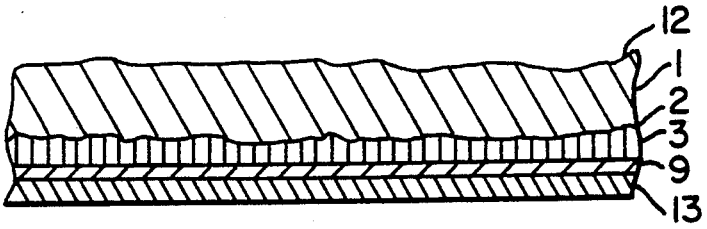

FIG. 19 is an amplified diagrammatic section of a typical sandwich in accordance with this invention, just before application of the decal onto a substrate, the reverse printing layer having been erased or the laminated sheet peeled off, and the reverse image having been coated with an adequate adhesive.

Figure 20A:
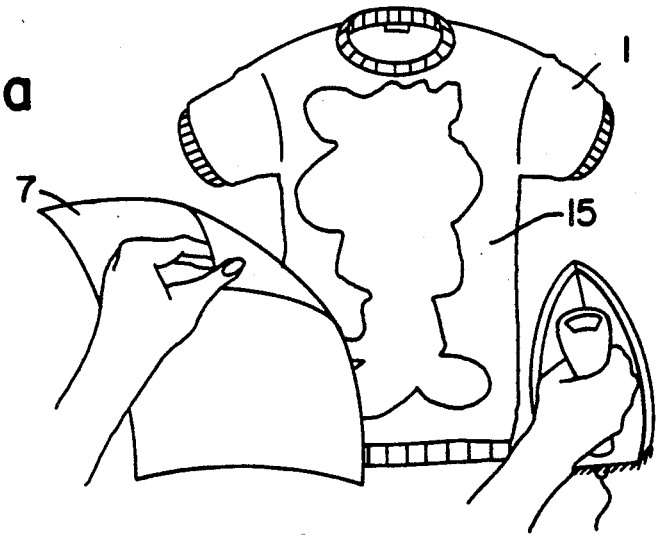

FIG. 20*a* is a perspective view, showing how the decal is applied with heat.

Figure 20B:
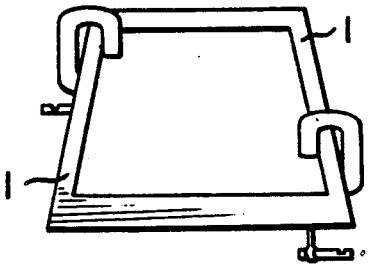

FIG. 20*b* is a perspective view, showing how the decal may be applied with pressure.

Figure 21:
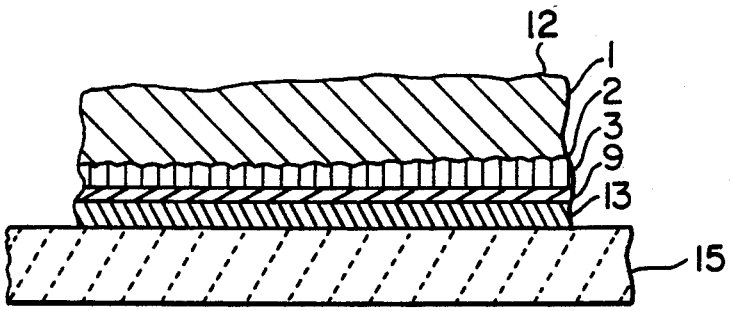

FIG. 21 is an amplified diagrammatic section of a typical decal in accordance with this invention, applied on the desired substrate.

Figure 22:
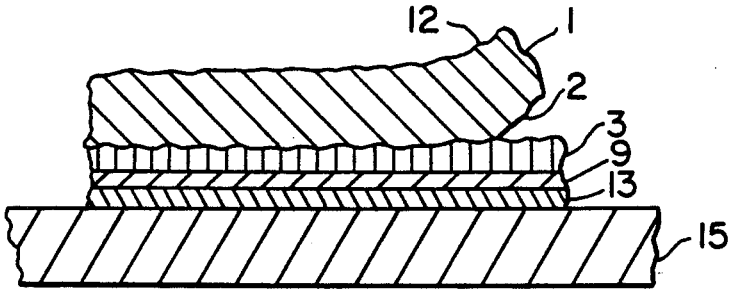

FIG. 22 is an amplified diagrammatic section of a typical decal in accordance with this invention, applied on the substrate, with the paper base of the support sheet in the begining of removal.

Figure 23:
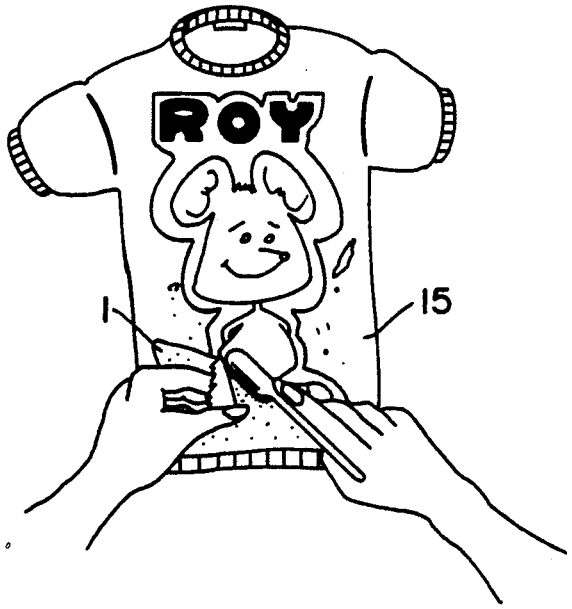

FIG. 23 is a perspective view, showing how the paper base of the support sheet is being removed.

DETAILED DESCRIPTION

Figure 1A:
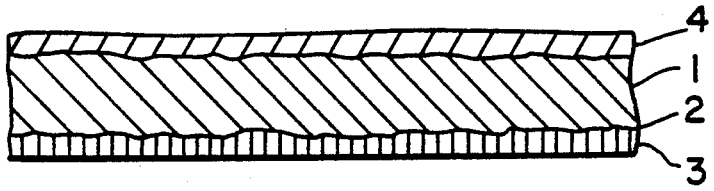
Figure 1B:
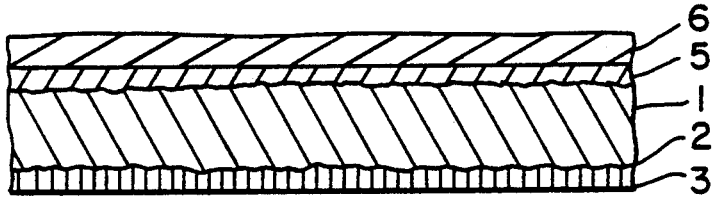
Figure 1C:
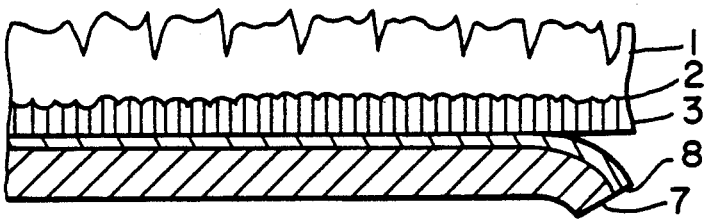

The FIGS. 1*a*, 1*b*, 1*c* and 1*d* show typical sections of typical support sheets in accordance with this invention. The dry paper base (1) has a porous surface (2), on which a film of plastic resin (3) (below referred to as the plastic film) has been applied in such a manner that the film gets in reverse the same texture as the paper surface, without penetrating said surface but adhering well to it. Various kinds of plastics may be used, depending on the intended use of the decal. If the plastic film is derived from a liquid lacquer, varnish, adhesive, emulsion or solution of plastic resin, the liquid cannot be applied directly to the paper because it would penetrate. Thus, the application of the plastic film should be indirectly, such as by lamination or transfer coating, both methods well known by experts in the art. FIG. 1*c* shows the lower part of a support sheet on which the film (3) has been applied with transfer coating. A dry release paper with a paper base (7) and the surface covered with a release layer of silicone (8) may be left over the film (3) as protection. This type of decal paper is especially adequate for transfers from other papers. The user may use the protective silicone release paper, when removed, as an ironing paper for the decal.

A water emulsion of acrylic polymer has proved to work well as coating medium. The emulsion may have a solids content of about 46%, dispersed in water with the aid of a suitable nonionic emulsifier. A very small amount of suitable defoaming agent that prevents formation of bubbles or the so called "orange peel" effect as the coating dries should be added to the polymer.

The emulsion is first applied on the release paper, and dried, and thereafter the dried film is transferred to the paper to be coated by means of heat and pressure. A film thickness of between one half and one mil (0.001 inch) has been found suitable. The coated sheets of release paper dry in 10–15 minutes at room temperature. The sheets do not dry flat if left to dry in the air. On the other hand, this does not affect the end results, as the release paper flattens completely during the transfer stage.

FIGS. 1*a* and 1*b* show two types of the reverse side of the support sheet, both types intended to make the sheet more waterproof during the first steps of the process, and to facilitate the opening of the pores of the paper base (1) for maximum penetration of water, before application of the decal. In FIG. 1*a*, the reverse side has a printed or colored layer (4) which one erases with the aid of a brush and water. As a result, this reverse layer gets removed and the reverse side of the support sheet becomes completely open for penetration of water. The same result is obtained if the sheet (6), shown in FIG. 1*b*, and which is glued to the paper base (1) with an adhesive (5) is peeled off. The sheet (6) may be of paper as well as of plastics; one may use adhesive coated film intended for lamination on paper.

Figure 1D:
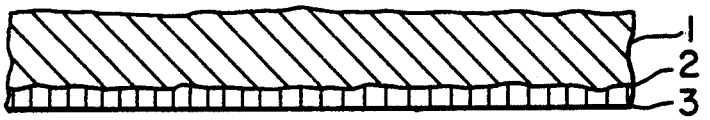

FIG. 1*d* shows a support sheet in accordance with this invention, in which the reverse side of the paper base (1) has no water-resistant coating such as (4) in FIG. 1*a* or (5) and (6) in FIG. 1*b*. The paper used should have an open porous reverse side through which water will readily penetrate. The other side has, as in FIGS. 1*a* and 1*b*, a plastic film (3) adhering to but not penetrating the porous surfaces (2) of the paper base (1). This support sheet can be used for preparing decals for commercial use, in which an image is printed directly on the plastic film (3), or transferred to the plastic film (3)

under controlled industrial manufacturing conditions which avoid any chance of water contacting the reverse side of paper (1). The reverse side can, of course, carry a printed text, such as instructions for use of the decal but the text would not serve any purpose related to the function of the decal.

The paper (1) may be sheeted and printed with layer (4) using common printing systems, such as letter press, offset, silkscreen. For large quantities, web printing of rolls, such as by web offset or rotogravure is recommended. It is desirable to use inks having a plastic resin base in order to obtain a satisfactory degree of water resistance of the rear side of the support sheet (1).

To apply by lamination a protective sheet (6) of FIG. 1*b* it is economic to use a web of paper supplied in rolls. One may, for instance, use the Fasson Cold Seal adhesive polyester film in thickness of ½ or 1 mil. Such lamination may be done over a printed back surface. Instead of a plastic film, it is possible to use adhesive paper in rolls, or paper without adhesive, the latter being supplied in a laminating machine during the lamination process. The paper adhesive will supply water resistance. In the case of paper lamination, the paper ought to be printed ahead of the lamination. The adhesive bond must be cured sufficiently so as to tolerate the ironing of the sheet.

Figure 2A:
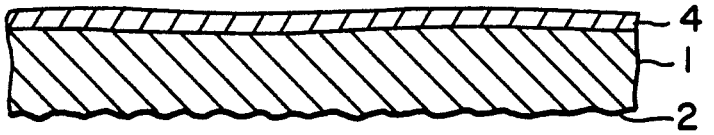
Figure 2B:
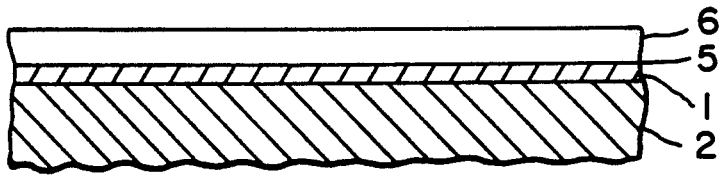

The FIGS. 2*a* and 2*b* show other versions of the support sheet in accordance with this invention, which do not yet have a plastic film on its surface intended for application of the image, but which have the reverse side equal to the ones of the support sheets shown in FIGS. 1*a* and 1*b*.

Figure 3:
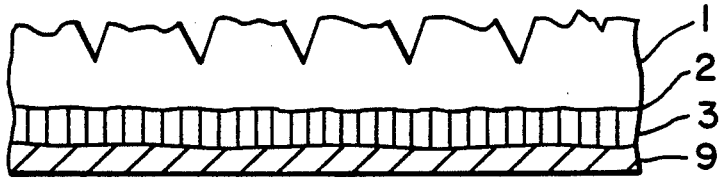
FIG. 3 is an amplified diagrammatic section of the lower part of any one of the support sheets shown in FIGS. 1*a*, 1*b*, 1*c* and 1*d*, on which an image has been applied directly on the support sheet.

FIG. 3 shows the lower part of the section of a support sheet in accordance with this invention on which the image (9) has been applied with known means, such as printing, copying or drawing, etc.

Figure 4:
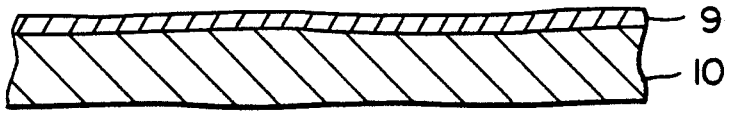
FIG. 4 is an amplified diagrammatic section of a paper on which an image has been applied.
Figure 5:
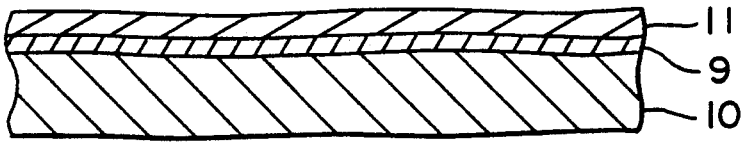
FIG. 5 is an amplified diagrammatic section of the paper shown in FIG. 4, a plastic film having been applied over the image.

In FIG. 5, the image (9) shown in FIG. 4 has been coated with a plastic film (11). Almost all kinds of lacquers or emulsions with a plastic base could be utilized, the choice dependent on how the decal is to be utilized and the properties of the substrate where it is going to be applied.

Figure 6:
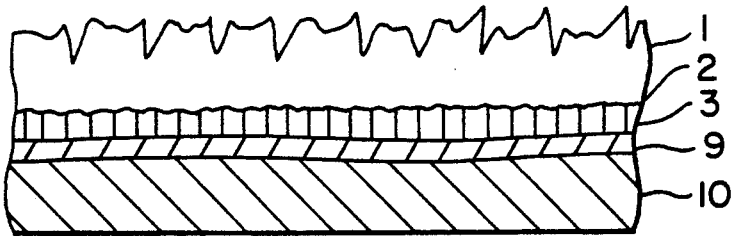
FIG. 6 is an amplified diagrammatic section of the lower part of any one of the support sheets shown in FIGS. 1*a*, 1*b* and 1*c*, in which the paper with an image, shown in FIG. 4, has been applied on the plastic film.

FIG. 6 shows the paper (10) with the image (9), shown in FIG. 4, in contact with the film (3) of a support sheet such as those shown in FIGS. 1*a*, 1*b* and 1*c*. This type of application is possible if one applies heat and pressure and the film (3) is compatible with the inks of the image (9), Various thermoplastic films, such as acrylic and vinyl films, work well with pictures in magazines printed with inks based on plastic resins.

Figure 7:
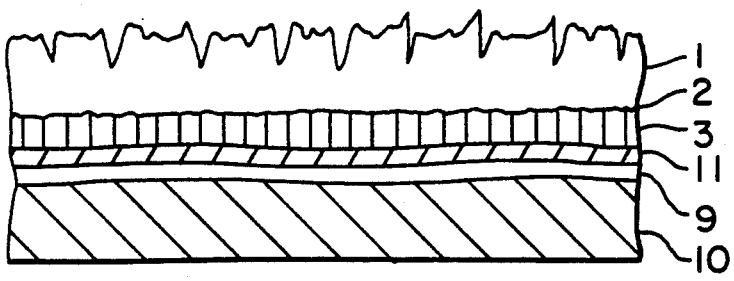
FIG. 7 is an amplified diagrammatic section of the lower part of any one of the support sheets shown in FIG. 1*a*, 1*b* and 1*c*, in which the paper with a coated image, shown in FIG. 5 has been applied on the plastic film.

In FIG. 7 the paper (10) with the image (9), coated with a plastic film (11), shown in FIG. 5, has been applied on a decal paper of the type shown in FIGS. 1*a*, 1*b* and 1*c*, leaving the coated image (11) against the plastic film (3) of the support sheet. This application is preferably made after the coating (11) has dried, utilizing heat and pressure. A domestic iron is sufficient for small and medium sized images. The application is almost instantaneous, some 20–30 seconds for the bond if the plastic film of the support sheet is of acrylic base. In fact, a film (3) of acrylic base of the support sheet will facilitate the application of a great number of coatings (11) of the image, including those which are not compatible, such as some polyester films. Notwithstanding, with heat the acrylic film becomes tacky and it adheres sufficiently well to non-compatible materials, that the resultant bond supports all of the steps of the transfer of an image from another paper. After the image has been transferred to the desired substrate, the acrylic film (3) may be removed.

Figure 8:
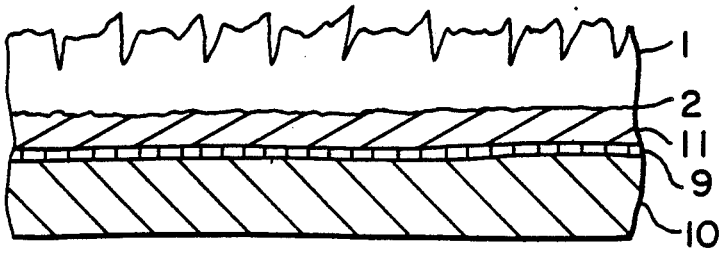
FIG. 8 is an amplified diagrammatic section of the lower part of any one of the support sheets shown in FIGS. 2*a* and 2*b*, in which the paper with the coated imamge, shown in FIG. 5, has been applied on the non-printed/non-laminated surface.

In FIG. 8, the paper (10) with the image (9) coated with a plastic film (11), is shown applied with the plastic film (11) against the porous surface (2) of a support sheet of the versions shown in FIGS. 2*a* and 2*b*. This type of support sheet is the most economic version for transfer of images applied on other papers; here the image and the plastic film are transferred at the same time and together. However, the process of removing the image paper base is more delicate with this version than with those shown in FIGS. 1*a*, 1*b* and 1*c*.

Figure 9:
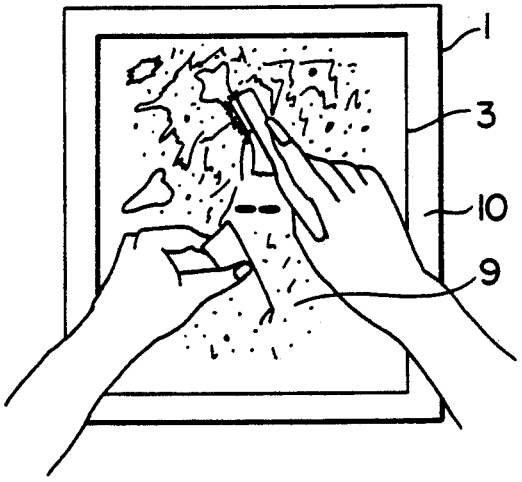
FIG. 9 is a perspective view, showing how the paper base of the image is removed in one of the sandwiches shown in FIGS. 6, 7 and 8.

FIG. 9 shows how the paper base (10) can be removed in a sandwich of the types shown in FIGS. 6–8. Ideally, no water ought to pass outside of the image (9) paper base (10). However, it is difficult to control the water, and it is not possible to avoid that at times it spills outside. In a support sheet of the kind shown in FIGS. 1*a*, 1*b* and 1*c*, there are no problems if this happens as the film (3) serves as a waterproof layer.

In fact, it is possible to submerge the sandwich in water before removing the paper base (10) with a brush. While it would be possible to lift the film (3) at one of the edges, after the sandwich has been submerged, this does not affect the image (9), which is firmly glued to the film 3. No sideways movement can take place, as the film (3) has obtained the same texture as the surface (2), in reverse, and this effectively keeps the film (3) and the image (9) adhering in position.

Figure 10:
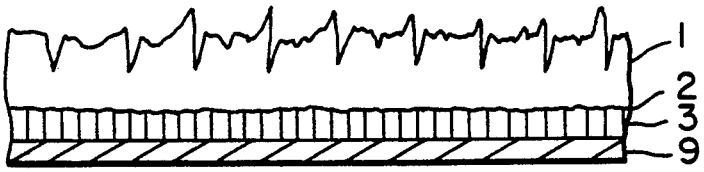
FIG. 10 is an amplified diagrammatic section of the sandwich shown in FIG. 6, after the image base of paper has been removed.
Figure 11:
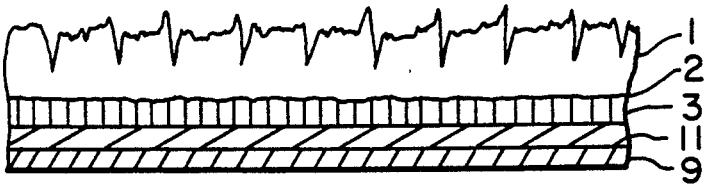
FIG. 11 is an amplified diagrammatic section of the sandwich shown in FIG. 7, after the image base of paper has been removed.
Figure 12:
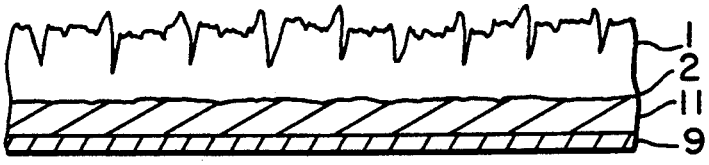
FIG. 12 is an amplified diagrammamtic section of the sandwich shown in FIG. 8, after the image base of paper has been removed.

In the FIGS. 10, 11 and 12, it is shown how the sections shown in FIGS. 6–8 will look after the paper base (10) of the image (9) has been removed. It is necessary that all paper is removed to obtain a good transfer, especially to leather and fabrics.

Figure 13:
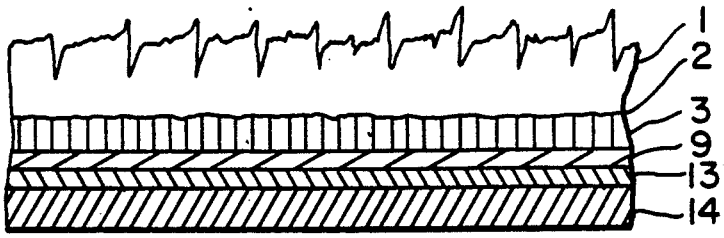
FIG. 13 is an amplified diagrammatic section of the sandwich shown in FIG. 10, after a white or tie adhesive coat has been applied over the printing inks.

FIG. 13 shows the section of a decal which is to be applied on a dark substrate. It is necessary to apply a white coat (13) over the image (9), if the inks are transparent. Said coat, such as of zinc oxide or a white printing ink, should be compatible with the plastic film (3) of the support sheet as well as with the inks of the image (9) and the desired substrate. This coat may as well serve as adhesive. For example, if the decal is to be applied on leather, the coat 13 may be fused with the lacquer which normally has been applied on the surface of leather, or which has been especially applied in order to facilitate the application. On the other hand, if the decal is to be applied on fabric, if the emulsion used to fuse the image to the fabric is not compatible with the printing inks of the image, it becomes necessary to give a tie-coat to the image (9), which may be white or transparent, and may, for example, be an acrylic emulsion. The coat (13) may represent such a tie-coat. Thereafter, one may apply the emulsion (14) which is to be used to apply the decal on the fabric, and semi-cure said coat with heat at a lower temperature than the one used for application of the decal on the fabric.

The white coat or the tie coat may be applied before or after the decal is trimmed to desired size and form.

Figure 14:
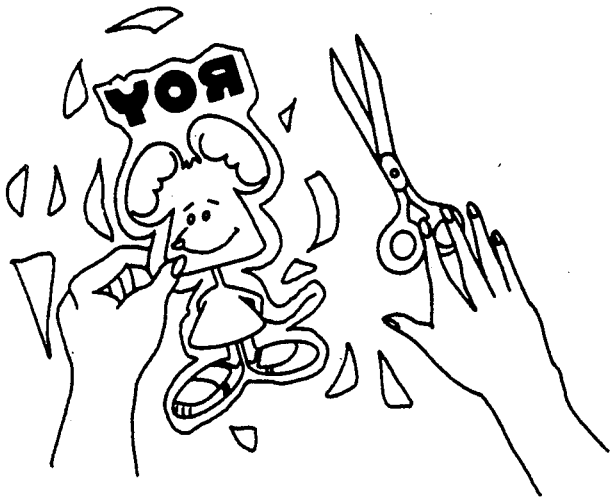
FIG. 14 is a perspective view, showing how the decal is trimmed by hand.

FIG. 14 illustrates how the decal is trimmed by hand. In order to facilitate this, it is necessary that the paper base (1) of the support sheet is sufficiently rigid. The rigidity is also required during the application of the decal, which has become wet and soft during the preceding step. It is also necessary to have a paper base which is sufficiently heavy to serve as an elastic cushion during the penultimate step, during which the decal is applied on the substrate. For this reason, a rigid paper of sufficient weight, such as from 60 to 150 g/m$^2$, or a thin paper board, such as one of 120 to 200 g/m$^2$, with a suitable surface should be used for the paper base of the support sheet intended for transfers of images from other papers, and for decals made by hand. On the other hand, for decals made in a printing shop, one may use a paper base (1) which is less heavy.

Figure 15:
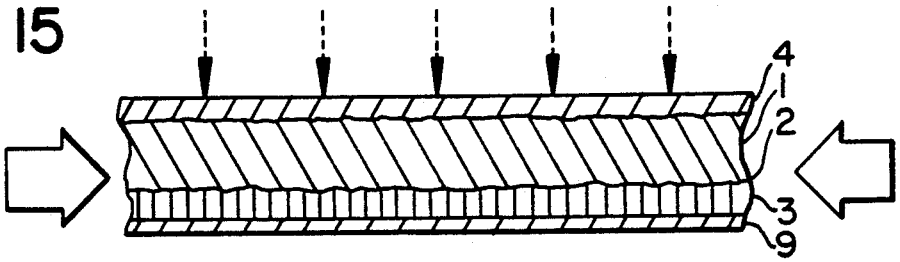
FIG. 15 is an amplified diagrammatic section of typical decal in accordance with this invention, illustrating how water enters the paper base of the support sheet, if the sandwich is submerged in water.
Figure 17:
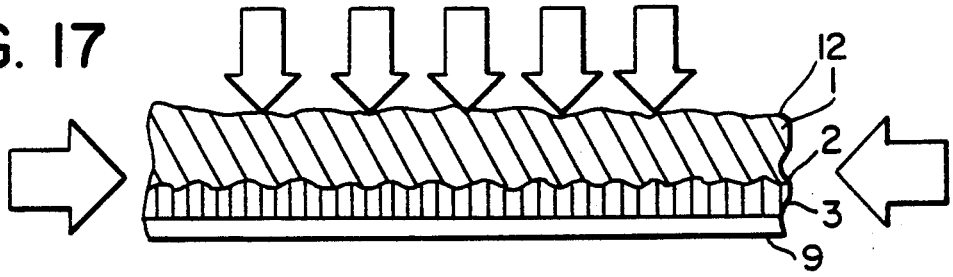
FIG. 17 is an amplified diagrammatic section of the sandwich shown in FIGS. 10 and 12, showing how water may penetrate the paper base of the support sheet after the printed layer has been erased, or the laminated sheet has been peeled off from the support sheet in accordance with this invention.

FIG. 15 shows a section of a decal in accordance with this invention, which is submerged in water. No water can enter through the image (9) or the plastic film (3). Some water may enter through the printed or colored layer (4). If instead of the layer (4) there were a plastic film or paper adhering, as in accordance with FIG. 1*b*, this would provide water proofness, and no water would penetrate the reverse side. Almost all penetration takes place through the cross section at the edges. A small decal may become saturated in a short period of time, while a large one needs much more time for sufficient water to penetrate to affect the film (3), the exact time being difficult to estimate. On the other hand, if we open up the reverse side (12) of the decal, as is shown in FIG. 17, the water penetrates rapidly. The open surface (12) may be obtained by treating the reverse side of a paper having a rather dense reverse surface with a brush and water: however, it is difficult to control that the surface layer is removed in a uniform manner, as it is not possible to control how much paper is being removed when no means of reference exist. The effect of this lack of control would be that water penetrates rapidly in some areas and more slowly in others, and for this reason the film (3) will not release at the same time in different spots. For this reason, the reverse side has a printed or colored layer, or a laminated sheet of plastic or paper. If only the printed or colored layer (4) is removed, or the sheet (6) in FIG. 1*b* which is adhering to the reverse side is peeled off, one causes the whole of the surface to open up uniformly. With the thus-treated support sheet, or with the support sheet of FIG. 1 *d* which had no coating on the reverse side, the water will pass uniformly through the open surface (12) and the cross section of the whole paper (1), causing said paper to release uniformly from the film (3) over the whole area. The time for release of the film (3) is the same for small and large decals, the speed to cause release being a function depending on the weight or thickness or quality of the paper.

Figure 16:
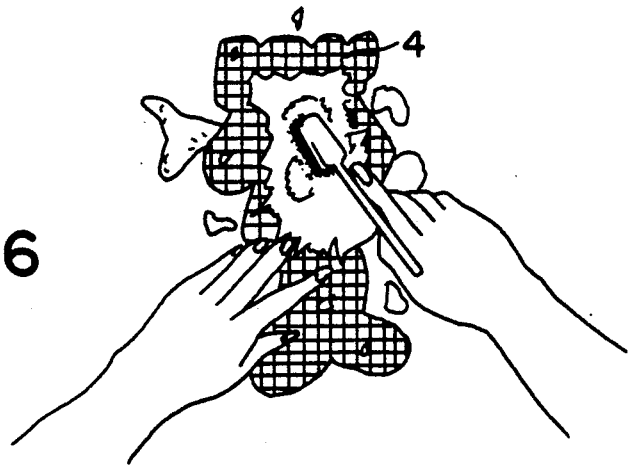
FIG. 16 is a perspective view of a typical decal in accordance wit this invention, illustrating how the printed layer of the reverse side of the support sheet may be erased.

FIG. 16 shows how the printed layer (4) is removed with the aid of a brush and water.

After the reverse side of the decal has been opened, the decal is submerged in water for a few minutes. When the decal is saturated, in other words, when the image (9) releases from the paper (1), one places the decal on a plane surface with the image (9) face up, and wipes the image (9) completely dry, as is illustrated in FIG. 18*a*. At this juncture, the film (3) which includes the image (9), could easily be lifted, but depending on the texture of the surface (2) of the paper base (1), and the texture of the film (3) to which the image (9) is firmly adhering, the image is firmly sustained in the horizontal plane, and there is no risk that it will slide sideways if one applies horizontal forces, such as those caused by the drying step shown in FIG. 18*a*. For this reason, it is possible to completely clean and dry the image (9) without risk of damage.

When the image (9) is completely dry, a layer of adhesive (13) is applied, if it had not been applied before the decal was submerged, or, if this was the case, a layer of adhesive 14, when this is necessary for the application. For some applications, there is no need to apply the layer (13) prior to applying the decal. For example, for transfer of art reproductions to canvas, which do not have to be washed, it is sufficient with a layer of emulsion or a white adhesive prior to application of the decal. On the other hand, decals which have been coated prior to submerging, as is illustrated in FIG. 13, may be applied without any further coat of adhesive, as is illustrated in FIG. 13. The adhesive (13) or (14) may also consist of a lacquer, varnish, emulsion or solution of a plastic resin, adequate for adhering to the desired substrate. A white adhesive such as an emulsion based on polyvinyl alcohol functions well on various surfaces.

For fabrics, it is convenient to use special emulsions intended for this material, such as those of vinyl base used in silk screen process printing of T-shirts, if one wants a transfer which may be washed. FIG. 18*b* shows the sandwich when a layer (13) or (14) is given to the reverse side of the decal, prior to its application on the desired substrate. The movements with the brush cause considerable sideways forces, especially if one uses an emulsion for fabrics (actually a paste), forces which the film (3) and the image (9) withstand for reasons mentioned above, notwithstanding the fact that this coat is given while the decal is still saturated with water.

FIG. 19 shows a diagrammatic section of the sandwich with the layer (13) applied on the reverse side of the image (9).

The FIGS. 20*a* and 20*b* show the decal applied on desired substrate. In FIG. 20*a* the desired substrate is a fabric on which the decal may be applied with an iron, as illustrated. If one uses an emulsion intended for fabrics, one irons for 3 seconds at a temperature of 200° C., which causes the decal to adhere sufficiently to remove the paper base (1) in one piece. Thereafter, the image is covered with a silicone coated paper (7 and 8), shown in FIG. 1*c*, and one irons additionally for 15 seconds, in order to cure the bond and fuse the image (9) into the surface (15).

On the other hand, if the decal may not be applied with heat, pressure may instead be applied over the bond with wet adhesive. Such a bond may require several hours to dry until it is sufficiently cured to remove the paper (1). Application with pressure could be done in a press, or simply with a weight over the sandwich. FIG. 20*b* shows this type of application with the aid of carpenters' clamps.

Instead of application with pressure, one may use the following method: the substrate is first coated with a suitable emulsion, e.g. acrylic emulsion, which is left to dry. When the decal has soaked for 5 minutes, it is removed and placed in position, exposed underside of image down. The wet paper backing is then removed, the image cleaned and any airbubbles sponged out. Thereafter, the image is covered with a coat of the same emulsion as was given to the substrate, and left to dry. After some time (5–10 minutes) the surface of the image becomes dry, while its underside becomes tacky, making it adhere to the substrate.

In FIGS. 20*a* and 20*b* the decal is applied on the final substrate (15) and the paper base (1) is still wet and saturated with water. The paper (1) serves as an elastic cushion when pressure is being applied over the rest of the sandwich in such a manner that the image (9) together with both layers (3) and (13) will adapt the same texture as that of the substrate (15).

FIG. 21 shows a diagrammatical section of the decal applied on the desired substrate (15). FIG. 22 shows the same decal applied on the substrate, the paper (1) beginning to be removed in one piece, as described above in respect of application of the decal on fabric.

Notwithstanding the fact that normally it is possible to remove the paper (1) in one piece, this does not always happen if the support sheet has dried or has been ironed too long a time. In these cases, some paper rests may remain, sticking to the image, this also being the case if the decal has been applied with pressure only. With a little bit of water and a brush, these paper rests are removed in seconds, as shown in FIG. 23. This result is due to the fact that the paper was completely released after having been submerged in water.

Referring back now to FIGS. 1*a*, 1*b*, 1*c* and 1*d*, the plastic film (3) may be applied to the paper base (1) either directly as by lamination, or indirectly as by transfer coating. Most thermoplastic films, such as acetate (polyvinyl acetate), polyethylene, vinyl (polyvinyl chloride), polyurethane, may be heat laminated to paper.

The temperature must not be too high, so as to prevent that the film melts and penetrates the surface of the paper. (If this happens, it will not be possible to release the paper from the film without paper fibers sticking to it). One skilled in the art can readily determine appropriate temperatures and time for chosen film and paper.

The step of transfer coating the paper base with the plastic film can be left to the consumer by providing to the consumer a stack of sheets of alternating (A) silicone coated release paper coated with plastic film and (B) printed paper base. The consumer would iron an (A) onto the unprinted side of a (B), thus adhering the plastic film to the paper base, and then remove the release paper, keeping it as an "ironing paper." This system saves the consumer the cost of transfer coating at the factory.

For pre-printed decals, the image may be printed directly on the plastic sheet of the support sheet. Alternatively, transfer printing may be used. The image is printed in full colors on a silicone-coated release surface of an endless web paper or fabric.

With the aid of the black color plate, the image is subsequently coated with an adequate lacquer, such as an acrylic polymer emulsion. After passing through a drying terminal the web is pressed at elevated temperature against a moving web of support sheet paper so that the coated image sticks to, but does not penetrate, the paper surface and releases from the release paper or fabric.

The coating of an image to be transferred to a support sheet can also be effected by use of a silicone treated release paper, in which the emulsion desired to coat the image may be carried by the release paper and transferred by heat and pressure to the surface of the image. This can be especially useful when the image does not completely cover the paper on which it exists, so that application of wet emulsion may result in some penetration, with consequent difficulty in removing the image backing.

It is sometimes feasible to press, with heat, a support sheet such as shown in FIGS. 1*a*–1*c* against an image, and thus directly transfer the image to the plastic film (3) without use of an adhesive emulsion. In such case the removal of the paper backing of the image is quite easy. Success of this method depends on compatibility of film and printing inks, eveness of the plastic film, and degree of applied temperature and pressure. Preliminary testing will determine whether this procedure will be effective for particular types of image and plastic film.

The following examples will illustrate some of the many aspects of the practice of the present invention.

A. Transfers

Example A1. A magazine picture is given 1 or 2 thin coats of an acrylic resin water emulsion. The emulsion is applied as a line at one of the edges of the picture, and is then distributed with an artist's brush over the whole of the picture with horizontal and vertical strokes, until touch dry. Without waiting for further drying, the picture is placed face down over a support sheet plastic film (½ mil.) prepared on the paper sheet of the support sheet from an acrylic emulsion in accordance with this invention (FIGS. 1*a*, 1*b* or 1*c*) and ironed with a household electric iron for 20 seconds at #1 (lowest) setting.

The paper backing of the picture is then gently rubbed with a tooth brush and water, and when saturated the paper backing removed. The magazine picture now appears in reverse on the support sheet plastic film as if it had been printed there.

Example A2. A magazine cover is placed face down over the plastic film of a support sheet and ironed on for 20 seconds at #1 setting. The support sheet plastic film becomes soft and tacky and sticks to the magazine cover picture, which had been coated during manufacture with a lacquer which was not heat sensitive.

The paper backing of the picture is then removed with water and brush, leaving the magazine picture appearing in reverse on the support sheet plastic film.

Example A3. A picture is drawn and colored with the use of color pencils on a clay-coated paper. The picture is thereafter given 1 or 2 thin coats of an acrylic emulsion. When dry, the coated picture is placed face down on the plastic film of a support sheet, and ironed on for 20 seconds. The picture paper backing is subsequently treated with a brush and water and, when saturated, the paper backing removed, leaving the picture appearing in reverse on the support sheet plastic film.

Example A4. The outline of the picture mentioned in Ex. 3 is obtained through photocopying on a zinc oxide coated electrostatic copying paper. The picture is thereafter colored and transferred in the same manner as the one mentioned in Example A3.

Example A5. Rhoplex AC-33 (Rohm and Hass Company, Philadelphia, Pa.), an aqueous emulsion of an acrylic polymer having a solids content of 46 to 47 percent, a PH of 9.4 to 9.9, a weight per gallon of 8.9 pounds, and a minimum film-formation temperature of 9° C., is suitable for use in Examples A1, A3and A4. Thereafter the coated picture is ironed on to a support sheet without a plastic film, of the kind shown in either FIGS. 2*a* or 2*b*. From then on, the treatment becomes identical with that described in the above examples. The transfers may be carried out with one coat only, but two coats make the process more certain.

B. Preparing the Decal for Application on a Dark Surface

Of the decal obtained in Examples A1–A5, all, with the exception of Example A4 and its counterparts in Example A5, are intended for application on a light surface, as the printing inks are transparent. The exceptions mentioned will have a white background, resulting from the layer of zinc oxide, and may, therefore, be applied on a dark surface. The decals of the other Examples may be adapted for application on a dark surface by way of painting the reverse image white, using a lacquer or paint which is compatible. One may also transfer the white zinc oxide layer from an electro-static copying paper, or white ink can be transfered from a clay coated paper of which one side has been printed with white ink. The following examples illustrate this step.

Example B1. If any of the decals of the kind just described is to be applied on a dark surface, the same acrylic emulsion used for the basic transfer is mixed with a white acrylic base lacquer in proportions 1 part lacquer with 2 parts emulsion. The decal is given two coats of the mixture in order to obtain sufficient opaqueness.

Example B2. A directly printed decal is intended to be applied on dark surfaces. For this purpose, the image, which has been printed in reverse on the plastic film of the support sheet in full four (or more) colors is overprinted with white ink, using the black color plate, as the last step. The white color covers the whole of the reverse image, overshadowing completely the previously printed colors.

C. Pre-application of Adhesive

Example C1. A decal, intended for application on fabric, is obtained by means of direct printing, using the silkscreen process. In accordance with the instructions of the manufacturer of the printing inks, the inks are pre-cured by passing through a tunnel with a temperature of 90° C., after application of each color, and will adhere to fabric if ironed-on at a temperature of 180° C.

Example C2. The decal of Example A4 is to be transferred to fabric, using an emulsion having a vinyl base, which does not adhere well to the zinc oxide layer. For this purpose, the reverse image white zinc oxide surface is given a tie coat of an acrylic emulsion. When dry, the acrylic coat is covered with a vinyl base paste, which is semi-c red by placing the decal in an oven with a temperature of 90° C. for 45 seconds, and will become tacky and cure at a temperature of 180° C.

Example C3. A decal of which the image has been directly printed is to be applied on leather. Tests of the leather surface indicate that the original lacquer coat is compatible with an acrylic emulsion. For this reason, the reverse image (which has been given a white color over-print) is given a coat of acrylic lacquer in a printing press. Alternatively, instead of the white ink layer, the image can be given a coat of white acrylic lacquer, compatible with the printing inks. This coating may also be carried out in a printing press.

Example C4. A decal, of which the image has been obtained by transfer from another paper, is to be applied on a leather surface, which has been painted with an acrylic base brown lacquer. The reverse image is given a coat with a white acrylic lacquer, which will serve as adhesive for the final transfer.

In all of these C examples, the coating given to the reverse image will serve as adhesive for the final transfer.

D. Preparation of the Substrate Surface

The surface on which the decal is to be appliced should be clean and free of any substance which may decrease the adhesion of the image. Therefore it is recommended to clean the substrate ahead of the transfer. A number of substrates do not need any other preparation. However, on non-porous surfaces, such as glass, metal, plastics and wood, it is recommended that the surface be given a coat of clear lacquer, latex glaze or acrylic emulsion prior to the final application. While some substrates are heat sensitive, such as thermoplastics, or leather covered with a lacquer, the surface is not necessarily compatible with the adhesive to be used for the application of the decal. Then it will be necessary to either find another adhesive, or give a tie coat to the substrate area of application.

Example D1. A glass plate is to be decorated with a magazine picture. A decal in accordance with Example A1 is prepared. The plate surface is coated with a latex glaze, on which the decal is then applied, using an acrylic emulsion as adhesive.

Example D2. A transfer is to be made of an art reproduction onto textured cotton fabric. As a first step, the art reproduction is transferred to a support sheet, as in Example A1. In order to facilitate the adhesion to the cotton fabric, the fabric is given one coat of acrylic emulsion, slightly diluted with water to penetrate the fabric well. When the fabric has dried, the decal is applied.

E. Application on the Final Surface

Application on Paper

Example E1. An advertising agency is to prepare a folder in full colors. In order to demonstrate a mockup of the folder, it is decided to make photocopies of each page, which are then hand colored and transferred to support sheets in accordance with this invention. The decals are then applied on paper of the same type as that to be used for the folder, in the following manner:

After the decals have had the rear layers removed and had been submerged in water for 5 minutes, they are first placed on paper towels with the images up. The images, are wiped clean and dry, whereafter thin layers of acrylic emulsion are applied. Alternatively, one can use other adhesives, e.g., white adhesive or adhesive of an adhesive bar. Next, the decals are placed in their exact positions on the paper, and ironed for about 3–4 seconds at #3 setting, whereafter the support sheet paper bases are removed, leaving the images adhering to the paper as if they had been printed there. It is possible to iron for a longer period, but then the paper base of the support sheet may have to be removed with a brush and some water. While this is possible, it may leave the paper smudgy and uneven. Therefore, it is better to iron a short period, however long enough to make the image stick.

Application on Fabric

Example E2. An art reproduction is to be transferred to a textured cotton canvas. A decal is prepared in any of the manners explained in section A above. The canvas is given one coat of white acrylic lacquer, in order to provide best possible background color and also to obtain best possible adhesion between the canvas and the transferred picture. The decal rear printed layer is removed as follows. The decal is submerged in water for a few seconds, whereafter it is removed and placed with the printed squares layer up. The printed layer is then erased to 20%–30% by means of a brush of rough cloth or sponge with abrasive surface, such as the type used for cleaning dishes, and the decal submerged for 2 minutes, after which all of the rear printed layer of squares is peeled or rolled off. The decal is then submerged for 5 minutes, removed and placed on a paper napkin, reverse image up, and the image is wiped clean, whereafter it is given a coat of acrylic emulsion. Thereafter it is laid on top of the canvas, coated side down, and ironed for 4 seconds at #3 setting (nylon), in order to apply the image provisionally. Next, the support sheet paper backing is removed (normally in one piece) and the image is covered with a paper napkin and ironed for 60 seconds at same setting, with application of more pressure. The paper napkin is then washed away, using a sponge, and the picture wiped dry. The result: a textured picture which much resembles an original oil, and which has not been possible to achieve with other methods.

Example E3. A factory prints decals on support sheets in accordance with this invention, which have also been trimmed and supplied with a pre-cured layer of textile adhesive. A decal of this type is purchased in a retail shop and is being applied on a T-shirt of the customer, as follows. The decal is submerged in water for 5 minutes, whereafter it is placed on a paper towel, reverse image up. The image is wiped completely dry, after which the decal is placed in desired position, reverse image down, support sheet paper base still wet or damp. The wet back is then ironed with application of pressure, for 2 seconds at "cotton" setting. The support sheet paper backing is then removed (normally in one piece). The image is then covered with a silicone coated release paper (which could have been adhering to the back of the decal, as a protection), or with a paper napkin, and ironed for 20–30 seconds at "cotton" setting. When cool, the silicone paper is removed, or the paper napkin is removed using a sponge and some water, leaving the image permanently fused into the T-shirt fabric.

Example E4. A picture has been transferred to a support sheet in accordance with section A above, and is now to be applied on a T-shirt. The decal has been trimmed, the rear side layer of printed squares removed, and the decal submerged for 5 minutes in water. The decal is removed from the water and placed on a paper napkin, reverse image up. The image is wiped completely dry, whereafter it is given a coat of an acrylic polymer emulsion. Without waiting for the emulsion to dry, the decal is placed in its desired position on the T-shirt, coated reverse image down, wet paper backing up. The decal is ironed for 4 seconds at #3 (nylon) setting, whereafter the support sheet paper backing is removed in one piece. Next, the exposed image is treated with a vinyl (polyvinyl chloride) paste, which is rubbed into its surface, whereafter it is covered with a silicone coated release paper, and ironed for 20–30 seconds at "cotton" setting. After a few seconds of cooling, the release paper is removed, leaving the image fused into the fabric.

Application on Wood

Example E5. A family coat of arms is to be applied on a wooden shield. For this purpose, a photocopy is prepared of the outline, amplified to desired size, which is then painted and transferred to a support sheet of this invention as described in Section A above. The resultant decal is then trimmed, whereafter the rear layer of printing is removed and the decal submerged in water for 5 minutes. While still wet, it is placed in position on the wooden shield, exposed underside of picture down. The plastic film of the decal is of polyurethane basis, and the wooden shield has also been given a coat of a lacquer of the same basis. The decal is pressed down with the fingers, whereafter the paper backing is removed. The picture is wiped clean and any remaining air bubbles sponged or brushed out. Finally, the picture is given a coat of the same lacquer (polyurethane). While the surface will dry in some 5–10 minutes, the underside of the picture will become tacky (because of molecular migration) having as a result that the picture will adhere to the wooden shield. (The picture may be given one or several additional coats of the lacquer in order to make it resistant to wear).

Application on Stone

Example E6. A stone is to be used as a decorative paper weight, and for this reason it is to be covered with a decal, which has been prepared in accordance with Section A above, trimmed and provided with a white background in accordance with Section B. The reverse image is coated with an acrylic polymer emulsion, and the stone given one coat of the same in order to provide good adhesion for the image. After the reverse layer of the support sheet paper base has been removed and the decal has been soaked for 5 minutes, it is retrieved and put in place on the stone, white coated underside of picture down. Using the finger tips, the decal is made to take on the irregular form of the stone, facilitated by the elasticity of the plastic film and of the wet paper base of the support sheet. Next, the remainder of the support sheet paper base is removed with the aid of a sponge and water. The plastic film with the image adhering is pressed down further on the surface of the stone, and any air bubbles sponged out, making the film take on the texture and form of the stone. Finally, the picture is given one coat of acrylic polymer emulsion, making the picture adhere well to the surface of the stone, which has been given a prior coat of the acrylic emulsion.

Application on Asphalt and Concrete Surfaces

Example E7. A company parking lot is to have alloted parking spaces, marked by numbers and names in black over a yellow background. For this purpose, names and numbers are painted in black on support sheets in accordance with this invention, utilizing paint specifically suited for the parking lot surface. Subsequently, the ready decals are brought on site. After removal of the decal rear printed layer, if present, and 5 minutes of soaking in a bucket of water, the exposed reverse image of each decal is first wiped dry and then given a coat of yellow asphalt/concrete paint, serving as background color as well as adhesive. Thereafter each decal is placed in position while the paint is still wet. Some pressure is applied to secure good contact, such as placing a stone or stones over the decals, which are then left to dry for 12 hours, after which the support sheet paper backings are removed, using some water and a brush, leaving the images, adhering to the concrete/asphalt surface.

The numbers and names can be painted with the use of stencils indoors, leaving minimum time for the outdoors application. If the decal plastic film is compatible with the paint, it stays on top of the paint as an extra layer of protection, otherwise it is easily discarded at the same time as the paper backing is being removed, or left to slide off by itself.

Application on Metal

Example E8. The logo of a company is going to be applied on the company trucks. For this purpose, the logo is printed in reverse on support sheets in accordance with this invention, using the silk screen process, with Exello (TM of Advanced Process Supply CO.) PE series colors. The decal is soaked for 5 minutes in water, whereafter it is removed and put in place on the surface of the truck, which has been given a prior coat of a clear lacquer of the same family as the Exello colors, exposed underside of the picture down. The decal is pressed against the surface with the force of the hands, whereafter the paper backing is removed, (peeled away in one or several large pieces). The picture is wiped clean and any airbubbles sponged out. Although it does not stick to the surface, it adheres sufficiently well to carry out these steps in a secure manner. Finally, the picture is coated with the same lacquer as the underlying surface.

Application on Ceramics

Example E9. A restaurant is to have its logo applied on their crockery. For this purpose, the logo is printed on support sheets in accordance with this invention, using the silkscreen Process, as follows: First a base coat CUP 9119 (TM of Advance Process Supply Co.) is applied on the support sheet plastic film, then the colors are mixed, utilizing 70 parts of dry ceramic colors with 30 parts of CUP-9008 (TM of A.P.S. Co.), printed and cured under a mercury vapor lamp. The trimmed decals are then applied on the plates and cups by hand as follows: First the decals are soaked for 5 minutes. Then the image is cleaned and dried and given a coat of CUP 9119 whereafter the decals are placed in posititon, and the paper base removed. A few minutes of curing under a single mercury vapor lamp, leaves the image adhering to the ceramic surface, covered primarily by the CUP-9119 base coat and over it the support sheet plastic film. The plates and cups are then fired for 17 hours at a temperature of 1050. The plastic film burns, and left is the logo as an integral part of the ceramic surface.

Test to Determine the Strength of the Bond Between the Plastic Film and the Paper Base of Support Sheets and Decals in Accordance with this Invention The test was carried out in an INSTRON (Registered Trade Mark) Universal Testing Instrument Model 1130 with a MICRON II (Registered Trade Mark) computer and printer.

The test comprised Support Sheets in accordance with FIGS. 1*a* and 1*d*, as well as decals prepared by transfer of images to Support Sheets in accordance with FIGS. 2*a* and 2*b*, using the procedure described in Example A5.

The Paper Base of the Support Sheets in accordance with FIGS. 1*a*, 2*a* and 2*b* consisted of a paper board in accordance with the below specifications, while the one of the Support Sheet in accordance with FIG. 1 *d* was an ordinary bond paper used for photo copying, having a weight of 60 g/cm$^2$.

| | |
|---|---|
| Basic Weight | 193.5 g/m$^2$ |
| Caliber | 9.2–9.5 Points |
| Smoothness LT | 195 Sheffield Units |
| Smoothness LF | 180 Sheffield Units |
| Tension SM | 10.666 g/cm$^2$ |
| Tension ST | 7.943 g/cm$^2$ |
| Elmdorf SM | 156 g |
| Elmdorf ST | 168 g |
| Stiffness SM | 33 Taber Units |
| Stiffness ST | 13 Taber Units |
| Whiteness | 79% Photo Volt |
| Penetration | 500 sec. |
| Ash | 10.5% |
| Dennison LT | 14 No. Wax |

-continued

| | |
|---|---|
| Dennison LF | 16 No. Wax |

The Plastic Film was based on an acrylic emulsion of the kind described in Example A5, although of a different brand with different viscosity. The thickness of the film was 0.015 mm in respect of the Support Sheet in accordance with FIG. 1*d*, and 0.0125 mm for the rest.

The test was carried out with strips about 2 cms wide and 10 cms long, which were cut out from the Support Sheets and Decals. The ultimate 2 cms of the Plastic Film side of each strip was laminated to a strip of adhesive tape of about the same dimensions. The exceeding nonlaminated portion of the adhesive tape was double folded in order to make it non-tacky.

The test was divided into two parts, the first one to measure the maximum shearing stress the bond between the Plastic Film and the Paper Base could tolerate and the second one to determine the initial pulling force required to peel off the Plastic Film from the Paper Base. In the first test, the non-laminated end of the strip was fixed to the testing instrument's lower grip. The folded end of the adhesive tape was the fixed to the instrument's upper, pulling grip. The joint strip was then subject to a pulling force at a crosshead speed of 20 cms per minute, until the Plastic Film was pulled off from the Paper Base. The force required to achieve this represents the maximum shearing stress the bond between the Plastic Film and the Paper Base may be subject to without one layer sliding in relation to the other. With regard to Support Sheets and Decals in accordance with this invention, this force, below referred to as S, and expressed in kg/cm$^2$, represents the maximum horizontal force the Plastic Film may become subject to without getting damaged. As stated above on page 7, and on page 17, in connection with FIG. 9, considerable shearing stress forces act on the Plastic Film during the stage when the paper of a transferred image is being removed. However, while strong, these forces are much less than S-values obtained during the test. These values do also verify that the Plastic Film adheres very well to the Paper Base, even after having been submerged in water, and may thus withstand rough movements of a brush or the fingers during said paper removal stage, even if the paper has become wet. As can be seen from Example T2, a decal based on a Support Sheet in accordance with FIG. 2*a* will tolerate almost the same shearing force as in dry condition, after having been submerged for 5 minutes. As can be seen from Example T3, a decal on a Support Sheet in accordance with FIG. 2*b* will still withstand considerable shearing stress after having been submerged for 1 hour. This test does also verify the statements on page 6 above, and on page 21 in relation to FIGS. 18*a* and 18*b*, that the bond between the Plastic Film will withstand the sideways forces acting on it when adhesive is being applied on the Plastic Film after that the decal has had its rear protection layer removed and been submerged for 5 minutes. These forces are considerably less than the 1.07 kg/cm$^2$ shearing stress obtained in Example T5.

In the second part of the Test, the Paper base of each strip was laminated to a paper strip extending beyond the laminated end of the test strip. The end of the extended portion of said paper strip was fixed to the testing instrument's lower grip. The adhesive strip/tape non-laminated portion was the folded back 180° and fixed to the machine's upper, pulling grip, thereby facilitating pulling at a 180° peeling angle. The joint strip was then subject to a pulling force at the same crosshead speed of 20 cms/min., until the Plastic Film peeled off from the paper Base. The instrument registered the force required to initiate the peeling. This force is below referred to as P and expressed in g/cm². While the force to continue the peeling was found to be almost the same as P, in dry condition, very little force is required to continue the peeling of a wet decal, once the peeling has been initiated. However, the test showed that the force required to initiate the peeling was almost the same for a wet and a dry decal. The test also proved that the force P is much less than S under most conditions, excepting decals with Support Sheets in accordance with FIG. 1*d* and having a thin Paper Base. However, for these decals, which are not supposed to be subject to the same shearing stress as the other kinds, the reduced shearing stress tolerance after submerging in water is an advantage, as it will facilitate the rapid removal of the P paper Base from the image after application Finally, it was observed during the test that a considerable amount of the Paper Base paper stuck to the peeled off Plastic Film, while in respect of the wet strips, very little or no paper was found adhering to the Plastic Film.

Example T1 Strips, about 2 cms wide and 10 cms long were cut out from Support Sheets in accordance with FIGS. 1*a* and 1*d*, as well as from a decal with the Plastic Film and Image located on a Support Sheet in accordance with FIG. 2*a*. The strips were tested in accordance with the above description. The following values were obtained:

| | |
|---|---|
| Support Sheet according to FIG. 1a: | S = 4.75 kg/cm²; P = 334 g/cm² |
| Support Sheet according to FIG. 1d: | S = 4.72 kg/cm²; P = 325 g/cm² |
| Decal on Support Sheet according to FIG. 2a: | S = 4.75 kg/cm²; P = 334 g/cm² |

Example T2. A decal having a Support Sheet in accordance with FIG. 2*a*, to which a Plastic Film with an image had been transferred in accordance with Example A5, was submerged in water for 5 min. without the decal rear printed layer having been removed. Thereafter, a strip was cut from the wet decal and tested as described above. The following values were obtained:

S=4.2 kg/cm²; P=310 g/cm².

Example T3: A decal having a Support Sheet in accordance with FIG. 2*b*, to which a Plastic Film with an image had been transferred in accordance with Example A5, was submerged in water for 5 minutes, without the rear laminated Plastic Sheet having been removed. Thereafter a strip was cut from the wet decal and tested as described above. The following values were obtained:

S=3.2 kg/cm²; P=310 g/cm².

Example T4: A Support Sheet in accordance with FIG. 1*d* was submerged in water for 5 minutes. Thereafter, a strip was cut from the wet sheet and tested as described above. The following values were obtained:

S=0.428 kg/cm²; P=328 g/cm².

Example T5: A decal having a Support Sheet in accordance with FIG. 2*a*, to which a Plastic Film with an image had been transferred in accordance with Example A5, was first having its rear colored layer removed and, thereafter, submerged in water for 5 minutes. A strip was then cut from the wet decal and tested, as described above. The following values were obtained:

S=1.07 kg/cm²; P=316 g/cm².

I claim:

1. A decal comprising a paper sheet base having a porous surface, a preformed sheet of plastic film applied with no intermediate layer directly to said porous surface such that it adheres well to the porous surface and adopts the texture of the same but does not penetrate it, and an image applied to said plastic film.

2. A decal according to claim 1, wherein the image is held on the plastic film solely by virtue of mutual adhesion at their touching surfaces.

3. A decal according to claim 1, having an adhesive layer between said image and said plastic film.

4. A decal according to claim 1, wherein said paper sheet base has been saturated with water, whereby the adhesion to said plastic film has been substantially released but the paper sheet base and plastic film have not separated and the decal can withstand substantial forces in the plane of the decal without causing such separation.

5. A decal according to claim 1, wherein said plastic film is a thermoplastic polymer.

6. A decal according to claim 1, wherein said plastic film is a thermosetting polymer.

7. A decal according to claim 1, having a water-resistant coating on the reverse side of said paper sheet base.

8. A decal according to claim 1, wherein said water-resistant coating on the reverse side of said paper sheet base comprises printed or painted text and/or design.

9. A decal according to claim 7, wherein a sheet of paper or plastic is glued to the reverse side of said paper sheet base to impart water-resistance.

10. A decal according to claim 1, wherein said plastic film has been applied to said porous surface of said paper sheet base by heat and pressure.

11. A decal according to claim 10 wherein said plastic film has been applied at a temperature which is not high enough to melt the film and cause it to penetrate the surface of the paper.

12. A decal according to claim 1, wherein the image has been applied directly on the plastic film by means of printing, copying, drawing or painting.

13. A decal according to claim 1, wherein the image has been applied on the plastic film by means of transfer of an image from another paper.

14. A decal comprising a dry paper sheet base having a porous surface, a preformed sheet of plastic film applied with no intermediate layer directly to said porous surface such that it adheres well to the porous surface and adopts the texture of the same but does not penetrate it, and an image applied to said plastic film.

* * * * *